US006941675B2

(12) United States Patent
Slingo

(10) Patent No.: US 6,941,675 B2
(45) Date of Patent: Sep. 13, 2005

(54) HAIR DRYER EMPLOYING FAR INFRARED RADIATION AND NEGATIVE IONS

(76) Inventor: Fred M. Slingo, 20140 Park Hill, Barrington, IL (US) 60010

( * ) Notice: Subject to any disclaimer, the term of this patent is extended or adjusted under 35 U.S.C. 154(b) by 186 days.

(21) Appl. No.: 10/065,304

(22) Filed: Oct. 1, 2002

(65) Prior Publication Data

US 2003/0046825 A1 Mar. 13, 2003

Related U.S. Application Data

(63) Continuation-in-part of application No. 09/837,688, filed on Apr. 18, 2001, now Pat. No. 6,481,116, which is a continuation-in-part of application No. 09/824,066, filed on Apr. 2, 2001, now Pat. No. 6,378,225.

(51) Int. Cl.[7] ..... A45D 20/00

(52) U.S. Cl. ..... 34/96; 34/269; 34/90; 392/375; 392/385

(58) Field of Search ..... 34/97, 90, 96, 34/98, 99, 266, 267, 269; 392/375, 379, 380, 381, 382, 383, 384, 385

(56) References Cited

U.S. PATENT DOCUMENTS

| | | | | |
|---|---|---|---|---|
| 4,263,500 A | | 4/1981 | Springer et al. | |
| 4,316,077 A | * | 2/1982 | Carlson | 219/370 |
| 4,636,617 A | * | 1/1987 | Petersen et al. | 338/303 |
| 4,757,183 A | | 7/1988 | Karey et al. | |
| 5,077,461 A | * | 12/1991 | Hasegawa | 219/553 |
| 5,636,318 A | | 6/1997 | Polaert et al. | |
| 5,996,243 A | | 12/1999 | Chang et al. | |
| 6,205,674 B1 | | 3/2001 | Kaizuka | |
| 6,205,677 B1 | | 3/2001 | Yune | |
| 6,285,828 B1 | | 9/2001 | Cafaro | |
| 6,640,049 B1 | * | 10/2003 | Lee et al. | 392/385 |

OTHER PUBLICATIONS

U.S. Appl. No. 10/065,149, filed Sep. 20, 2002, Slingo.

* cited by examiner

*Primary Examiner*—Henry Bennett
*Assistant Examiner*—Camtu Nguyen
(74) *Attorney, Agent, or Firm*—Wallenstein, Wagner & Rockey, Ltd.

(57) ABSTRACT

Devices and methods of drying hair are provided. The devices and methods of the present invention employ a material or a combination of materials capable of emitting far infrared radiation and negative ions during hair drying.

17 Claims, 4 Drawing Sheets

200
220
4
228
240
208
210
226
204
206
224
222
216
202
218
4
214
232
212
231

HAIR DRYER EMPLOYING FAR INFRARED RADIATION AND NEGATIVE IONS

CROSS REFERENCE TO RELATED APPLICATIONS

This patent application is a continuation-in-part of U.S. application Ser. No. 09/837,688, filed on Apr. 18, 2001 now U.S. Pat. No. 6,481,116 which is a continuation-in-part of Ser. No. 09/824,066, filed Apr. 2, 2001 of U.S. Pat. No. 6,378,225, issued on Apr. 30, 2002, the disclosures of which are herein incorporated by reference.

BACKGROUND OF THE INVENTION

The present invention relates to devices and methods of using material or a combination of materials capable of emitting both far infrared radiation (FIR) and negative ions. More specifically, the present invention relates to devices and methods for drying hair that employ a material or combination of materials capable of emitting both FIR and negative ions.

FIR commonly refers to electromagnetic radiation that has a wave length between the visible light region and the microwave region of the electromagnetic spectrum. In general, FIR or other like terms as used herein refers to electromagnetic radiation that has a wavelength ranging from about 5.6 microns to about 1000 microns.

Certain types of ceramics containing silica oxide and aluminum oxide are known to radiate FIR at room temperature, and to radiate elevated levels of FIR when heated. For example, some types of these ceramics are commonly referred to as bio-ceramics because of reported biological and physiological effects attributed to such materials. However, typical bio-ceramic materials do not emit negative ions at room temperature and are generally limited in their ability to do so unless subject to temperatures exceeding about 1000° F.

FIR-emitting bodies have been used in a variety of applications, such as increasing fuel efficiency, heating, ripening of fruit, deodorizing and inducing perspiration in humans. With respect to this latter use, FIR has been used in saunas as a substitute for traditional steam heat.

As disclosed in U.S. Pat. No. 6,205,677, it has been known for a hair dryer to employ a heater radiating far infrared radiation. As disclosed therein, the heater radiating far infrared radiation is a halogen heater that includes a heating wire within a gas-filled, quartz tube. Such a hair dryer employs far infrared radiation as well as heat convection to dry a user's hair. More conventionally, hair dryers are known to employ a heating wire, such as a nickel-chromium (Ni—Cr) wire, and rely upon heat convection only to dry a user's hair.

Materials are also known that possess a source material capable of emitting negative ions. These types of materials may be useful in industry and by consumers. For example, negative ions have been reported to possess antibacterial and deodorizing properties, and can be effective in removal of airborne pollutants, leaving behind clean and refreshed air. Negative ion technology has been applied to hair dryer applications. However, the application of negative ion technology can be problematic due to, for example, the fact that the application of the technology typically can require extensive modifications to existing processes, thus increasing costs associated with those processes.

Other materials are known, in general, that can admit both FIR and negative ions. For example, U.S. Pat. No. 6,402,991 discloses a function-enhanced shaped ceramic article obtained by mixing a powder of a functional material of at least one species selected from the group consisting of a mineral, a metal and metallic compound and a powder of a far infrared radiating material composed of a ceramic composition that contains $SiO_2$ and $Al_2O_3$ in specified amounts. Preferably, the amount of the far infrared radiating material is at least 30% weight and not more than 90% weight. As disclosed, this amount of far infrared radiating material is necessary for the article to be easily shaped into a plate-like or a ball-like shaped article. The function-enhanced shaped ceramic article can be directly added to water for antibacterial purposes as disclosed in Example 1.

U.S. Pat. No. 5,965,007 discloses a method of preparing water for human consumption and/or use. As disclosed, the method includes submerging ceramics that have an extremely high emissivity of far infrared in water in a specified amount; placing an electrode in the water; and allowing the water to stand for a predetermined period of time, preferably at least 12 hours. The ceramics have such a composition that $SiO_2$, $Al_2O_3$, $Fe_2O_3$, $MnO_2$, ZnO and CoO are provided in specified concentrations.

Consequently, a need exists to provide improved devices and methods employing both FIR radiating material and negative ion material, or a material that emits both FIR and negative ions.

SUMMARY OF THE INVENTION

The present invention relates to devices and methods of using material capable of emitting both FIR and negative ions and applying same in a variety of suitable applications. More specifically, the present invention relates to devices and methods for drying hair that employ such material or combination of materials that can emit an effective amount of FIR and negative ions.

Applicant has become aware that, by combining material that radiates FIR with material that emits negative ions, or employing a material that emits both FIR and negative ions, in devices and methods, enhanced results are achieved over devices and methods employing only FIR emitting material.

In an embodiment, the material at least includes a two part material with a first part including a material component capable of emitting FIR and an additional material component including an oxide material. In an embodiment, the first part and the second part respectively include about 95% by weight or less and about 5% by weight or more of the material. It will be understood that, in place of material that has constituent components capable of emitting FIR and negative ions, respectively, that a material that emits both FIR and negative ions can be substituted. In an embodiment, the material can include a single material with one or more constituents or a combination of two or more materials.

In an embodiment of the present invention, a hair drying device is provided. The hair drying device includes a housing and a material capable of emitting both far infrared radiation and negative ions wherein the material is constructed and so arranged within the housing such that an effective amount of the far infrared radiation and negative ions is emitted during hair drying.

In another embodiment, the present invention provides a hair dryer that employs a material capable of emitting far infrared radiation and negative ions. The hair dryer includes an elongate body having an inlet end defining an inlet and an outlet end defining an outlet; a fan adapted when driven to draw air into the inlet, to move air through the elongate body, and to blow air from the outlet; an electrical motor adapted when energized to drive the fan; and an electrical heater mounted within the elongate body wherein the material is mounted to the elongate body in proximity to the outlet end such that an effective amount of far infrared radiation and negative ions is emitted during hair drying.

In yet another embodiment, the present invention provides a hair dryer employing a material capable of emitting far infrared radiation and negative ions that includes an elongate body having an inlet end defining an inlet and an outlet end defining an outlet; a fan adapted when driven to draw air into the inlet, to move air through the elongate body; and an electrical heater adapted when energized to heat air moved through the elongate body by the fan wherein the material is mounted between the fan and the outlet in proximity to the electrical heater such that an effective amount of far infrared radiation and negative ions is emitted during hair drying.

In still yet another embodiment, a method for drying hair is provided. The method includes the steps of providing a hair dryer device that employs a material capable of emitting far infrared radiation and negative ions; operating the hair dryer; and emitting an effective amount of far infrared radiation and negative ions during operation.

An advantage of the present invention is to provide improved devices and methods that employ a material or combination of materials capable of emitting FIR and negative ions.

Another advantage of the present invention is to provide improved devices and methods for drying hair that employ a material or combination of materials capable of emitting FIR and negative ions.

Yet another advantage of the present invention is to provide devices and methods that enhance conditioning and/or treatment of an individual's scalp during hair drying.

Still yet another advantage of the present invention is to provide devices and methods that can enhance heating efficiency during hair drying.

Additional features and advantages of the present invention are described in, and will be apparent from, the following Detailed Description of the Invention and the figures.

DETAILED DESCRIPTION OF THE INVENTION

Figure 1:
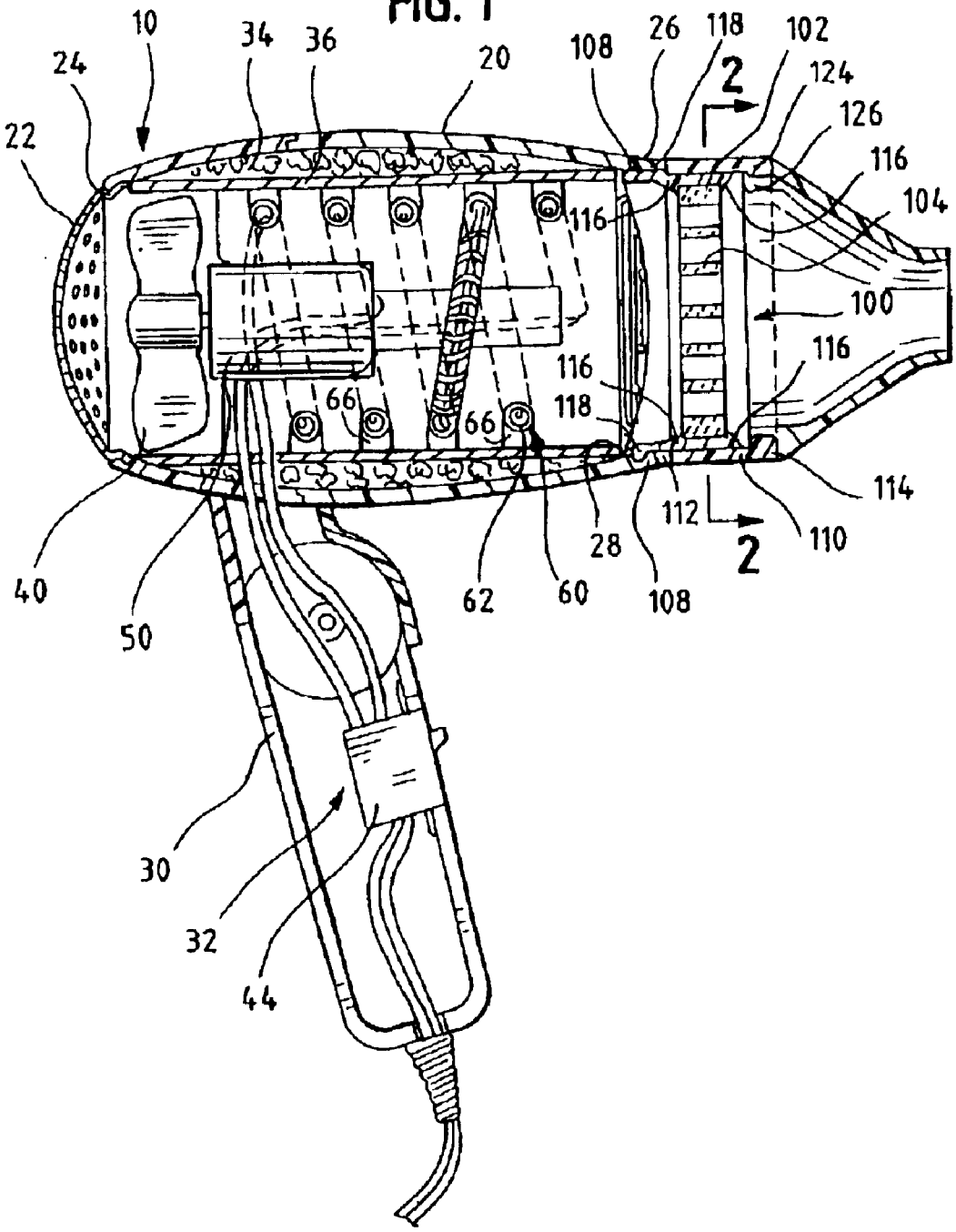
FIG. 1 illustrates a sectional view of a hair drying device according to an embodiment of the present invention.
Figure 2:
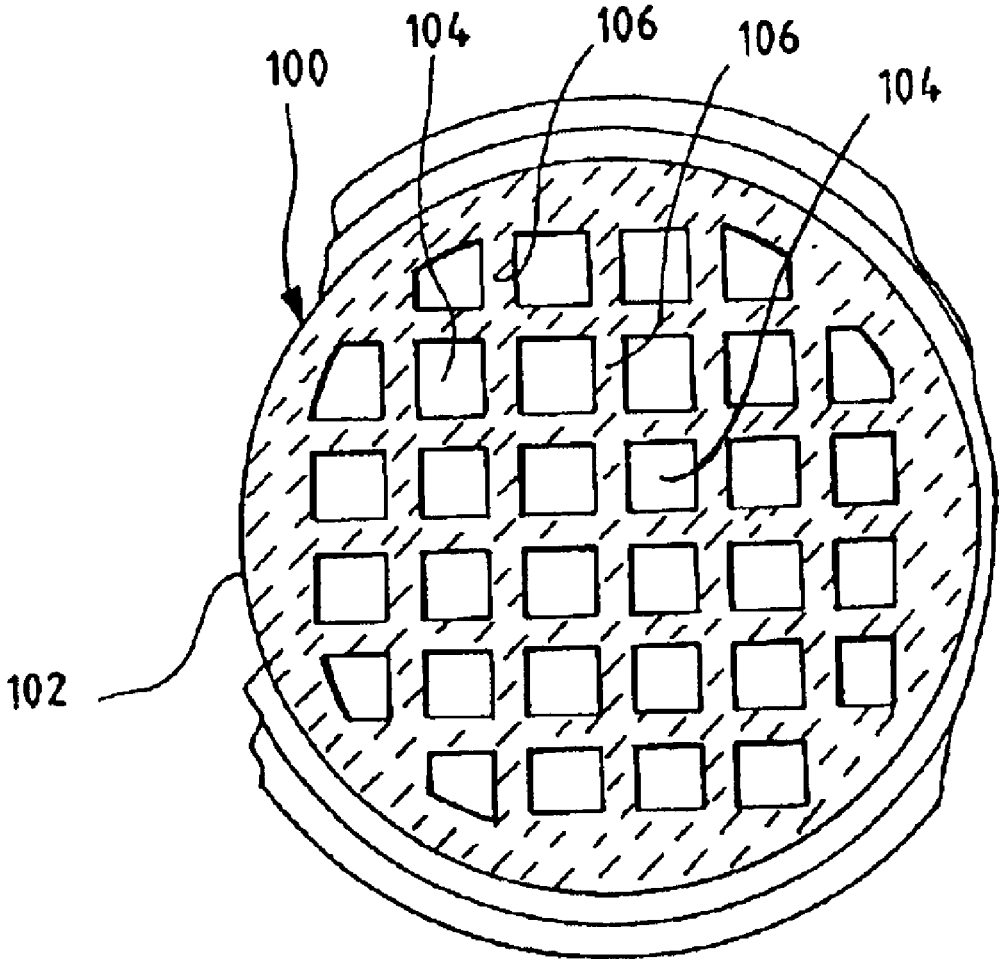
FIG. 2 illustrates a transverse, cross-sectional view taken along line 2—2 of FIG. 1 in a direction indicated by arrows according to an embodiment of the present invention.

The present invention generally relates to the use of material, or a combination of materials, that emit FIR and negative ions. More specifically, the present invention is directed to employing ceramic material or combinations of ceramic material in a variety of different applications, particularly relating to hair drying and processes thereof.

It is believed that the present invention can enhance these and other types of processes by exposing the processes to an effective amount of both negative ions and FIR emitted by the material or combination of materials of the present invention. Far infrared radiation is an energy source that can be characterized by its specific electromagnetic wave properties ranging from about 5.6 microns to about 1000 microns, preferably ranging from about 5.6 microns to about 25 microns. Negative ions, which are essentially negatively charged particles, are also an energy form.

In this regard, it is believed that the two part material energy source, or combination of energy sources, capable of emitting both FIR and negative ions can be adapted to have an enhanced activating effect with respect to the application thereof. For example, the combination of FIR and negative ions can enhance the efficiency of the heating process during hair drying. It is also believed that the emission of FIR and negative ions during hair drying can act to condition and/or treat an individual's scalp subject to hair drying. The devices of the present invention can be readily made while keeping costs to a minimum.

As previously mentioned, the present invention provides devices including a material or a combination of materials capable of emitting both FIR and negative ions. In an embodiment, the material includes a first part capable of emitting FIR and a second part that includes an oxide material. It is believed that the combination of these material components can provide improved properties as compared to known applications of ceramic materials.

In an embodiment, the material at least includes a first part and a second part. The first part and second part of the material of the present invention can be made of a variety of suitable materials. In an embodiment, the FIR-emitting material of the first part is composed of a bio-ceramic material. The bio-ceramic material can include, for example, silicon oxide ($SiO_2$), aluminum oxide ($Al_2O_3$), iron oxide ($Fe_2O_3$), magnesium oxide (MgO) and other suitable constituents, derivatives thereof or combinations thereof. These materials are commercially available or manufactured in any known way. It should be appreciated that the bio-ceramic material can include any suitable amount of the constituents.

The second part or additional oxide material includes, in an embodiment, iron oxide, silicon oxide, titanium oxide ($TiO_2$), aluminum oxide, magnesium oxide and other suitable materials, derivatives thereof or combinations thereof. The additional oxide material is commercially available. The additional oxide materials can also be manufactured according to known procedures. It should be understood, however, that the ratio of bio-ceramic material to the additional oxide material can vary depending on the desired application. In an embodiment, the material of the present invention includes about 95% by weight or less of the bio-ceramic material and about 5% by weight or more of the additional oxide material. Preferably, the bio-ceramic part includes about 70% by weight or more of silicon oxide, about 20% by weight or more of aluminum oxide, about 3% by weight or more of iron oxide, and about 2% by weight or more of magnesium oxide.

It should be appreciated that the FIR/negative ion emitting material of the present invention can be processed into a variety of different and suitable sizes. In an embodiment, the FIR/negative ion emitting material is formed into a rigid body that can include a number of different shapes and sizes depending on the application. While the FIR/negative ion emitting substance is a necessary component of the present invention, other materials optionally can be mixed with or added to the emitting substance. Other such optional substances may include, for example, binders, fillers and/or other suitable solid material processing substances.

In an embodiment, the present invention provides a hair drying device as illustrated in FIG. 1. The hair dryer 10 includes a ceramic heating element 100, also referred to as a ceramic radiator or other like term as used herein. The ceramic heating element 100 includes a material or combination of materials capable of emitting both FIR and negative ions as discussed above when heated in a manner described below in greater detail.

The hair drying device of the present invention can include a number of different and suitable components and can be constructed and so arranged in any suitable manner. In an embodiment, the hair drying device includes an elongate body 20, which has an inlet end 22 defining an inlet 24 and an outlet end 26 defining an outlet 28 and which has an attached handle 30 with an electrical switching mechanism 32 mounted thereon. The elongate body 20 is lined with thermally insulative materials 34, 36, of types used conventionally in hair dryers.

The hair drying device 10 further includes a fan 40, which is operable to draw air into the inlet 24, to move air through the elongate body 20, and to blow air from the outlet 28. The hair drying device also includes an electrical motor 50, which is adapted when energized to drive the fan 40 via a rotary shaft 42. The hair dryer 10 further includes an electrical heater 60, which is mounted within the elongate body 20, between the fan 40 and the outlet 28 and which includes an elongate coil 62 of a heating wire, such as a nickel-chromium (Ni—Cr) wire or the like. The elongate coil 62 is mounted within the elongate body 20 via mounting tabs 66.

The fan 40 and the electrical heater 60 are controlled by the electrical switching mechanism 32, through which the fan 40 and the electrical heater 60 are connectable to a source (not shown) of electrical power. The electrical switching mechanism 32 can include a single switch 44 to control the fan 40 and to control the electrical heater 60 or, if desired, a separate switch (not shown) to control the fan 40 and a separate switch (not shown) to control the electrical heater 60. The fan 40 and the electrical heater 60 may be thus controlled at a single setting for each or at plural, selectable settings for one or for both.

As mounted to the elongate body 20, at the outlet end 26, the ceramic heating element 100 is configured as a generally cylindrical body having an outer edge 102 and having a number of apertures 104, which are defined by crossed members 106 and through which air can flow when moved through the elongate body 20 by the fan 40 when energized.

A generally tubular adapter 110 having an inner end 112, an outer end 114, and two circumferential, radially inwardly projecting ribs 116 is provided such that the ceramic radiator 100 (e.g., heating element) can be mounted between the ribs 116. The elongate body 20, at the outlet end 26, and the generally tubular adapter 110, at the inner end 112, have respective formations 108, 118, which enable the generally tubular adapter 110 to be snap-fitted onto the elongate body 20, at the outer end 26, within the outlet 28, whereby to mount the ceramic radiator 100 onto the elongate body 20, at the outlet end 28. Being mounted to the elongate body 20, at the outlet end 26, as described above, the ceramic radiator 100 is mounted so as to be radiantly heated by the electrical heater 60 when the electrical heater 60 is energized and so as to be additionally heated by air being moved through the elongate body 20 by the fan 40 when the electrical motor 50 is energized and being heated by the electrical heater 60 when the electrical heater 60 is energized.

A flow modifier 120, at an inner end 122, and the generally tubular adaptor 110, at the inner end 112, have similar formations 124, 126, which enable the flow concentrator 120 to be snap-fitted onto the generally tubular adapter 110. In this regard, if the ceramic radiator 100 and the tubular adapter 110 were not provided, the flow concentrator 120 could be snap-fitted onto the elongate body 20, at the outer end 26, within the outlet 28. As shown, the flow modifier 120 is a flow concentrator of a known type, which is provided commonly on a hair dryer. Alternatively, the flow modifier could be a flow diffuser (not shown) of a known type, which is, provided commonly on a hair dryer.

It should be appreciated that as the generally tubular adapter 100 is mountable as and where the flow modifier 120 would be otherwise mounted, this invention enables a ceramic radiator, such as the ceramic radiator 100, to be readily adapted for any hair dryer having an elongate body with suitable formations enabling a flow concentrator or a flow diffuser to be snap fitted onto the elongate body, at or near an outlet end of the elongate body.

Figure 3:
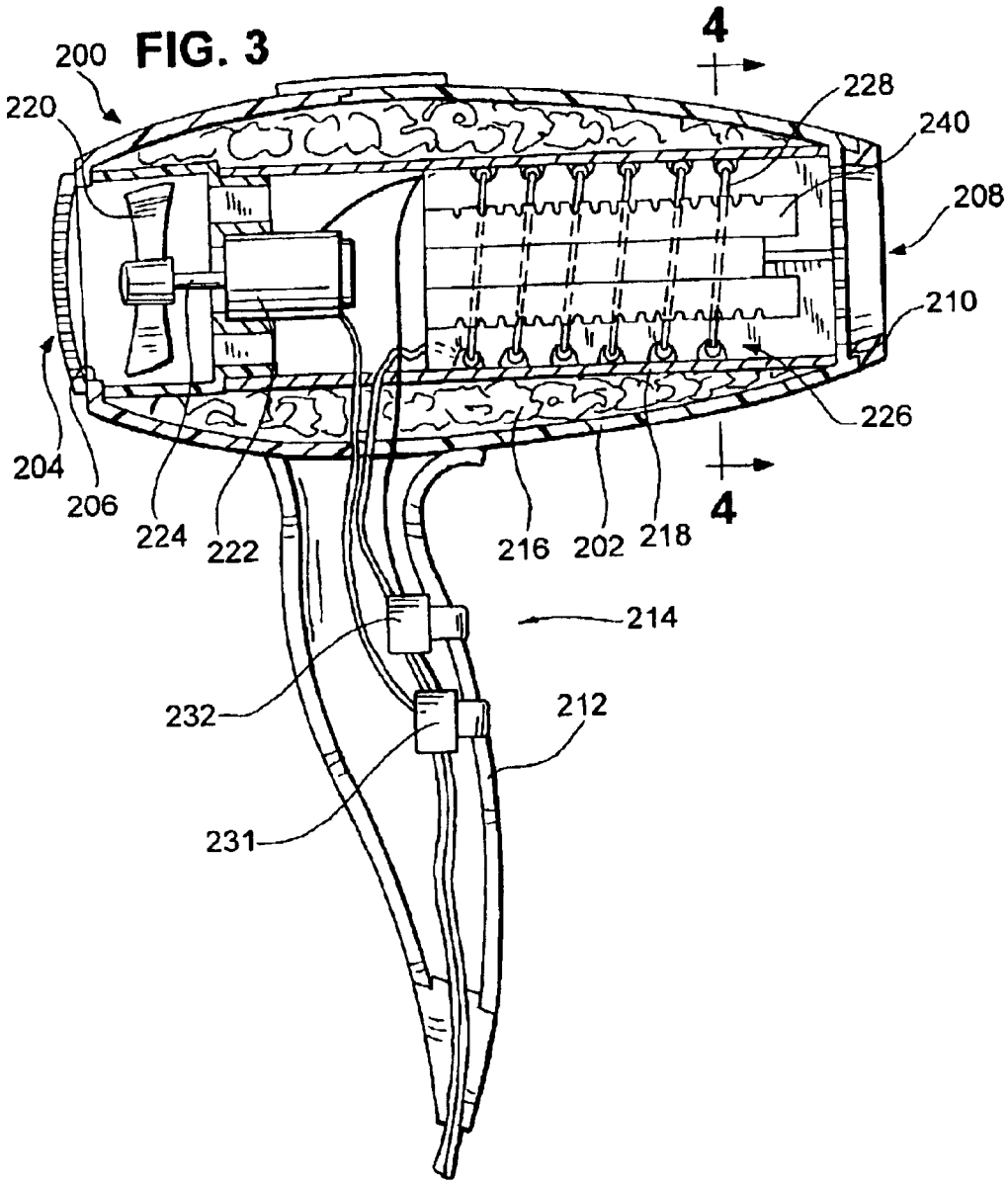
FIG. 3 illustrates a sectional view of a hair drying device according to another embodiment of the present invention.
Figure 4:
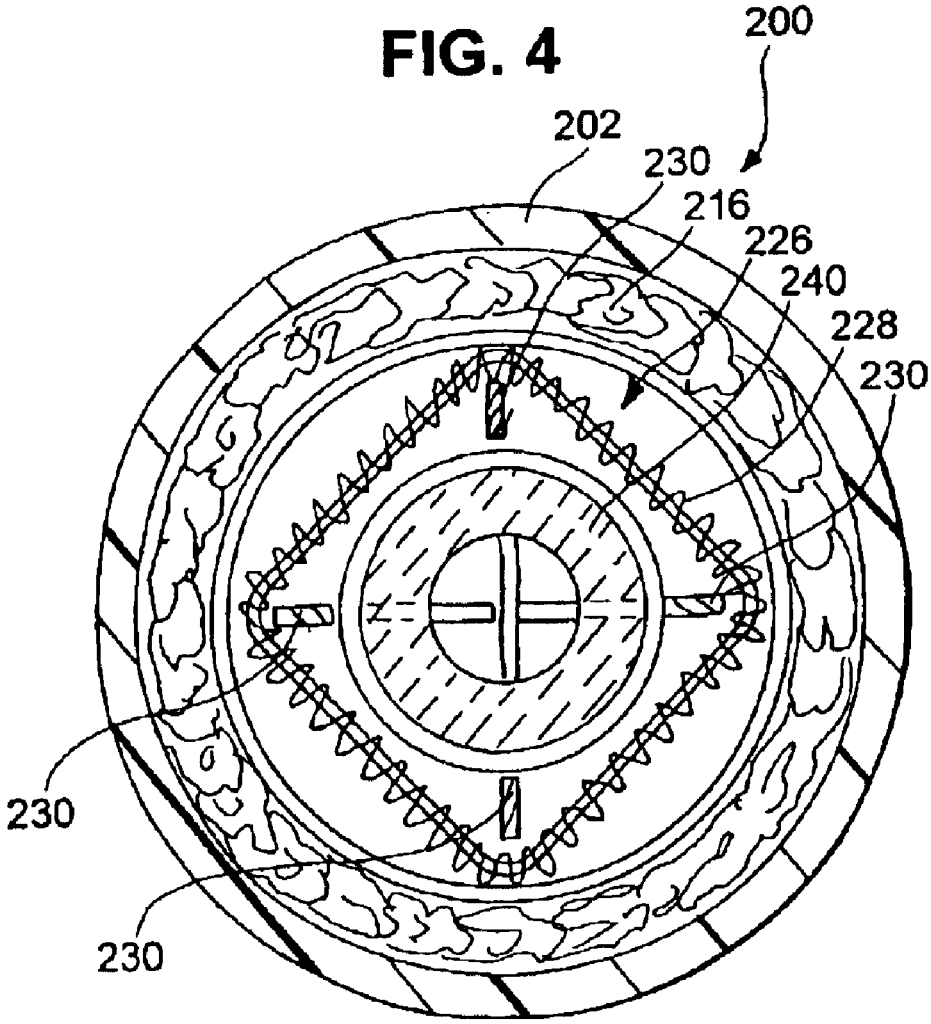
FIG. 4 illustrates a transverse, cross-sectional view taken along line 4—4 of FIG. 3 in a direction indicated by arrows according to an embodiment of the present invention.

In an embodiment, the hair dryer 200 is constructed as shown in FIG. 3. The hair dryer 200 includes an elongate body 202, which has an inlet end 204 defining an inlet 206 and an outlet end 208 defining an outlet 210 and which has an attached handle 212 mounting an electrical switching mechanism 214 as shown in FIG. 3. The elongate body 202 is lined with thermally insulative materials 216, 218, of types used conventionally in hair dryers.

The hair dryer 200 further includes a fan 220, which is adapted when driven to draw air into the inlet 206, to move air through the elongate body 202, and to blow air from the outlet 210, and an electrical motor 222, which is adapted when energized to drive the fan 200 via a rotary shaft 224. The hair dryer 200 also includes an electrical heater 226, which is mounted within the elongate body 202, between the fan 220 and the outlet 210 and which includes an elongate coil 228 of a heating wire, such as a nickel-chromium (Ni—Cr) wire. The elongate coil 228 is mounted within the elongate body 202 via two crossed mounting brackets 230.

The fan 220 and the electrical heater 226 are controlled by the electrical switching mechanism 214, through which the fan 220 and the electrical heater 226 are connectable to a source (not shown) of electrical power. The electrical switching mechanism 214 can include a single switch (not shown) to control the fan and to control the electrical heater 226 or, if desired, a separate switch 231 to control the fan 220 and a separate switch 232 to control the electrical heater 226. The fan 220 and the electrical heater 226 may be thus controlled at a single setting for each or at plural, selectable settings for one or for both.

The ceramic radiator 240, which is tubular in shape, is mounted within the elongate body 202, between the fan 220 and the outlet 210. The ceramic radiator 240 is suspended within the elongate coil 228, which is deployed around the ceramic radiator 240, via the previously mentioned brackets 230. The ceramic radiator is composed of a material or a combination of materials capable of emitting both FIR and negative ions as previously discussed. When the fan 220 and the electrical heater 226 are energized, the electrical heater 226 is adapted to heat air moved through the elongate body 202 by the fan 220 and to heat-the ceramic radiator 240, which radiates far infrared radiation and negative ions.

It should be appreciated that the hair dryer of the present invention can constructed in any suitable way. For example, the FIR/negative ion emitting material can be formed into a variety of suitable shapes and sizes. In this regard, the FIR/negative ion emitting material can be so arranged within the housing of the hair dryer so as to effectively enhance operation thereof. As compared to known hair dryers relying upon heat convection only, it is believed that the hair dryer of the present invention can be effectively operated at lower temperatures and with higher efficiencies. Moreover, it is believed that the emission of both FIR and negative ions onto one's scalp can effectively act to condition and/or treat the scalp during hair drying.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A hair drying device comprising a housing and a material separate from a heating element of the device, selected from the group consisting of a single material having one or more constituents and a combination of two or more materials, and capable of emitting both far infrared radiation and negative ions wherein the material is constructed and so arranged within the housing such that an effective amount of the far infrared radiation and negative ions is emitted during hair drying.

2. The hair drying device of claim 1, wherein the material includes a first part including a bio-ceramic in an amount of about 95% by weight or less and a second part including a ceramic oxide in an amount of about 5% by weight or more.

3. The hair drying device of claim 2, wherein the ceramic oxide is selected from the group consisting of iron oxide, silicon oxide, titanium oxide, aluminum oxide, magnesium oxide, derivatives thereof and combinations thereof.

4. The hair drying device of claim 2, wherein the first part comprises at least one compound selected from the group consisting of silicon oxide, aluminum oxide, iron oxide, magnesium oxide, derivatives thereof and combinations thereof.

5. A hair dryer capable of emitting far infrared radiation and negative ions, the hair dryer comprising:

an elongate body having an inlet end defining an inlet and an outlet end defining an outlet;

a fan adapted when driven to draw air into the inlet, to move air through the elongate body, and to blow air from the outlet;

an electrical motor adapted when energized to drive the fan;

an electrical heater mounted within the elongate body; and a material selected from the group consisting of a single material having one or more constituents and a combination of two or more materials, capable of emitting far infrared radiation and negative ions, and mounted to the elongate body separate from the electrical heater and in proximity to the outlet end such that an effective amount of far infrared radiation and negative ions is emitted during hair drying.

6. The hair dryer of claim 5, wherein the material includes a first part including a bio-ceramic in an amount of about 95% by weight or less and a second part including a ceramic oxide in an amount of about 5% by weight or more.

7. The hair dryer of claim 5 wherein the material is formed into a generally cylindrical body with a plurality of apertures through which air can flow.

8. A hair dryer capable of emitting far infrared radiation and negative ions, the hair dryer comprising:

an elongate body having an inlet end defining an inlet and an outlet end defining an outlet;

a fan adapted when driven to draw air into the inlet, to move air through the elongate body, and to blow air from the outlet;

an electrical motor adapted when energized to drive the fan;

a generally tubular adapter wherein the elongate body, at the outlet end, and the generally tubular adapter have respective formations, which are adapted to be snap-fitted together;

an electrical heater mounted within the elongate body; and a material having a generally cylindrical outer edge, capable of emitting far infrared radiation and negative ions, and mounted to the elongate body separate from the electrical heater and in proximity to the outlet end such that an effective amount of far infrared radiation and negative ions is emitted during hair drying.

9. The hair dryer of claim 8 wherein the material is mounted onto the elongate body, at or near the outlet end, within the outlet.

10. A hair dryer capable of emitting far infrared radiation and negative ions, the hair dryer comprising:

an elongate body having an inlet end defining an inlet and an outlet end defining an outlet;

a fan adapted when driven to draw air into the inlet, to move air through the elongate body; and an electrical heater adapted when energized to heat air moved through the elongate body by the fan; and a material capable of emitting far infrared radiation and negative ions mounted within the elongate body between the fan and the outlet in proximity to the electrical heater such that an effective amount of far infrared radiation and negative ions is emitted during hair drying.

11. The hair dryer of claim 10, wherein the material is selected from the group consisting of a single material having one or more constituents and a combination of two or more materials.

12. The hair dryer of claim 10, wherein the material includes a first part including a bio-ceramic in an amount of about 95% by weight or less and a second part including a ceramic oxide in an amount of about 5% by weight or more.

13. A hair drying device comprising:

a housing having an air inlet and an air outlet;

a fan disposed within the housing that draws a supply of air into the housing through the air inlet and forces the supply of air out of the housing through the air outlet;

an electrical heater disposed within the housing that heats the supply of air drawn into the housing;

a material, mounted to the housing and separate from the electrical heater, that emits far infrared radiation and negative ions; and an adapter connected to the housing such that the supply of air flows through the adapter, the material being disposed within the adapter.

14. The hair drying device of claim 13, wherein the material includes a first part including a bio-ceramic in an amount of about 95% by weight or less and a second part including a ceramic oxide in an amount of about 5% by weight or more.

15. The hair drying device of claim 13, wherein the adapter is removable from the housing.

16. The hair drying device of claim 13, wherein the electrical heater is concentrically positioned with respect to the material.

17. A hair drying device comprising:

a housing having an air inlet and an air outlet;

a fan disposed within the housing that draws a supply of air into the housing through the air inlet and forces the supply of air out of the housing through the air outlet;

an electrical heater disposed within the housing that heats the supply of air drawn into the housing;

a material, mounted to the housing adjacent the air outlet and separate from the electrical heater, that emits far infrared radiation and negative ions.

* * * * *